US005551698A

United States Patent [19]

Lyon

[11] Patent Number: 5,551,698

[45] Date of Patent: Sep. 3, 1996

[54] BOARD GAME

[76] Inventor: Robert F. Lyon, 577 Mill Rd., Coram, N.Y. 11727

[21] Appl. No.: 402,534

[22] Filed: Mar. 10, 1995

[51] Int. Cl.[6] ..... A63F 3/00

[52] U.S. Cl. ..... 273/246; 273/246.16

[58] Field of Search ..... 273/242, 243, 273/246, 146

[56] References Cited

U.S. PATENT DOCUMENTS

| | | | |
|---|---|---|---|
| 3,044,779 | 7/1962 | Hvizdash | 273/246 |
| 3,690,666 | 9/1972 | Seitz | 273/246 |
| 3,834,709 | 9/1974 | Lamb | 273/246 |
| 4,042,245 | 8/1977 | Zarour | 273/246 X |
| 4,624,463 | 11/1986 | Glennon | 273/246 |
| 4,917,386 | 4/1990 | Tozer | 273/246 |
| 5,092,605 | 3/1992 | Hoffman | 273/246 |
| 5,139,267 | 8/1992 | Trevisan | 273/246 |
| 5,308,078 | 5/1994 | Hatter | 273/246 |
| 5,322,293 | 6/1994 | Goyette | 273/246 |
| 5,350,178 | 9/1994 | Hollar | 273/246 |

FOREIGN PATENT DOCUMENTS

| | | | |
|---|---|---|---|
| 1288071 | 9/1972 | United Kingdom | 273/246 |

*Primary Examiner*—William E. Stoll

[57] ABSTRACT

A board game comprising: a playing board formed in a planar configuration with a race track printed thereupon, the track having an outer periphery with a plurality of lanes and a center section, each lane being comprising a plurality of individual printed blocks, the center section of the track including a plurality of racing related printed structures formed in a variety of shapes and sizes, at least one structure being formed contiguously with the periphery of the track, a plurality of additional words and symbols being imprinted upon the board, the game including a plurality of race car tokens and a random number generating system; and a set of playing rules informing the users how to play the game, the game adapted to be played by a plurality of players, the first player reaching the finish line after a predetermined number of laps around the track being declared the winner, the players moving their tokens around the track according to the results of the random number generating system, the game simulating a real life auto race by encouraging players to avoid the types of hazards normally found in a real race.

1 Claim, 3 Drawing Sheets

FIG. 4
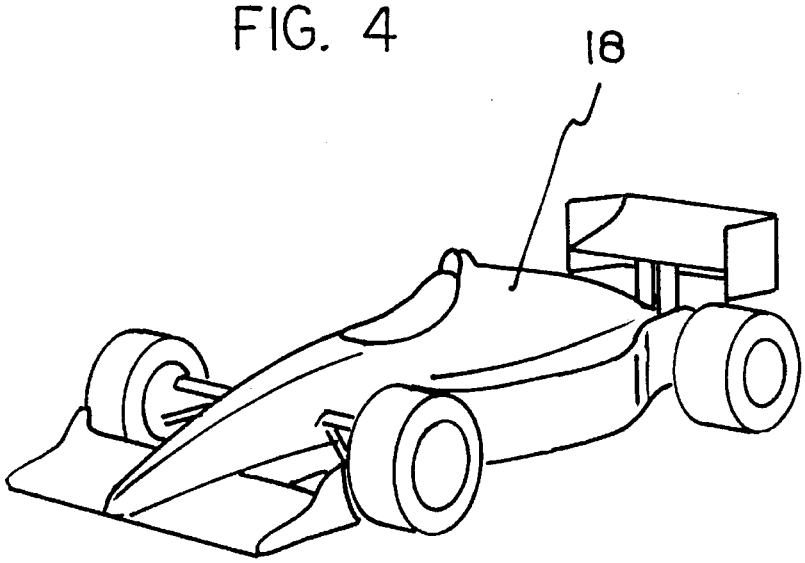
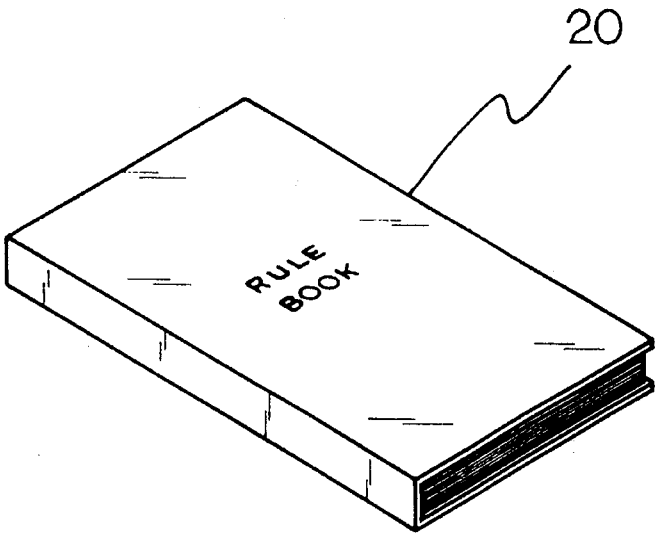
FIG. 5

BOARD GAME

BACKGROUND OF THE INVENTION

1. Field of the Invention

The present invention relates to a golden eagle 500 board game and more particularly pertains to entertaining users by traversing the track of the game board which includes many of the hazards of a real race.

2. Description of the Prior Art

The use of car race games is known in the prior art. More specifically, car race games heretofore devised and utilized for the purpose of entertaining users by playing the games in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,139,267 to Trevisan a method of playing a racing game.

U.S. Pat. No. 3,738,659 to Partridge discloses a auto racing board game apparatus.

U.S. Pat. No. 5,282,630 to Dupuis, Jr. discloses a car racing game apparatus.

U.S. Pat. No. 5,114,152 to Rouse et al. discloses a automotive racing game.

U.S. Pat. No. 4,357,017 to Schneider et al. discloses an auto racing game wherein a numbered array and player-actuated discs determine race car movement.

Lastly, U.S. Pat. No. 3,899,177 to Sells discloses an automobile racing board game apparatus.

In this respect, the golden eagle 500 board game according to the present invention substantially departs from the conventional concepts and designs of the prior art, and in doing so provides an apparatus primarily developed for the purpose of entertaining users by traversing the track of the game board which includes many of the hazards of a real race.

Therefore, it can be appreciated that there exists a continuing need for a new and improved golden eagle 500 board game which can be used for entertaining users by traversing the track of the game board which includes many of the hazards of a real race. In this regard, the present invention substantially fulfills this need.

SUMMARY OF THE INVENTION

In view of the foregoing disadvantages inherent in the known types of car race games now present in the prior art, the present invention provides an improved golden eagle 500 board game. As such, the general purpose of the present invention, which will be described subsequently in greater detail, is to provide a new and improved golden eagle 500 board game and method which has all the advantages of the prior art and none of the disadvantages.

To attain this, the present invention essentially comprises a new and improved golden eagle 500 board game comprising, in combination: a playing board fabricated of cardboard and formed in a planar generally rectangular configuration with an upper surface, a lower surface, parallel long side edges and parallel short side edges, the upper surface of the board including generally rectangular shaped race track with rounded edges, the track having an outer periphery with four lanes and a center section, each lane traversing the perimeter of the board and comprising one hundred individual printed blocks on one inch squares; the center section of the track having a plurality of structures printed therein, each structure being formed contiguously with the periphery of the track, two circular shaped structures being positioned adjacent to each long side edge, the circular shaped structures including the words FLAT TIRE positioned therearound, two generally rectangular shaped structures including the words PIT DAMAGE and being positioned opposite each circular structure, structure including the word Gas printed therewithin, the structure being positioned at about the center point of a long side edge of the track; a generally rectangular shaped printed structure including black and white squares in a checker board configuration, the word CRASH being positioned at the approximate center point of each long side edge, the corners of the track being rounded and including the printed word SKID positioned adjacent thereto, the blocks of the printed corners being all colored red, white and blue, the blocks adjacent to the corners being colored all black; the game including three six sided white dice with black dots, one six sided black die with white dots and a plurality of race car tokens fabricated in a wide variety of colors, designs, and numbers; and a set of playing rules informing the users how to play the game, the game adapted to be played by between one and forty four players, each player being permitted to control multiple race car tokens, the car tokens being positioned adjacent to the start/finish line to begin the game, the first player reaching the finish line after five laps around the track being declared the winner, upon commencement of their turn each player rolling all four dice and moving the number of blocks indicated by the total of the dice, players landing on a crash square being required to move backward the number of blocks indicated by the black die, players rolling four dice of equal amount being permitted to roll and move again, players being required to traverse the printed gas structure during their second and fourth laps or lose their next five turns, players landing on a green block of a structure in the track being required to traverse the periphery of the structure, players being prohibited from jumping over other cars as they make their way around the board.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved golden eagle 500 board game which has all of the advantages of the prior art car race games and none of the disadvantages.

It is another object of the present invention to provide a new and improved golden eagle 500 board game which may be easily and efficiently manufactured and marketed.

It is further object of the present invention to provide a new and improved golden eagle 500 board game which is of durable and reliable constructions.

An even further object of the present invention is to provide a new and improved golden eagle 500 board game which is susceptible of a low cost of manufacture with regard to both materials and labor, and which accordingly is then susceptible of low prices of sale to the consuming public, thereby making such golden eagle 500 board game economically available to the buying public.

Still yet another object of the present invention is to provide a new and improved golden eagle 500 board game which provides in the apparatuses and methods of the prior art some of the advantages thereof, while simultaneously overcoming some of the disadvantages normally associated therewith.

Still another object of the present invention is to entertain users by traversing the track of the game board which includes many of the hazards of a real race.

Lastly, it is an object of the present invention to provide a new and improved golden eagle 500 board game comprising: a playing board formed in a planar configuration with a generally oval shaped race track printed thereupon, the track having an outer periphery with a plurality of lanes and a center section, each lane being comprising a plurality of individual printed blocks, the center section of the track including a plurality of racing related printed structures formed in a variety of shapes and sizes, at least one structure being formed contiguously with the periphery of the track, a plurality of additional words and symbols being imprinted upon the board, the game including a plurality of race car tokens and a random number generating system; and a set of playing rules informing the users how to play the game, the game adapted to be played by a plurality of players, the first player reaching the finish line after a predetermined number of laps around the track being declared the winner, the players moving their tokens around the track according to the results of the random number generating system, the game simulating a real life auto race by encouraging players to avoid the types of hazards normally found in a real race.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective illustration of one of the race car player tokens.

FIG. 5 is a perspective illustration of the rule book of the apparatus.

The same reference numerals refer to the same parts through the various Figures.

DESCRIPTION OF THE PREFERRED EMBODIMENT

Figure 1:
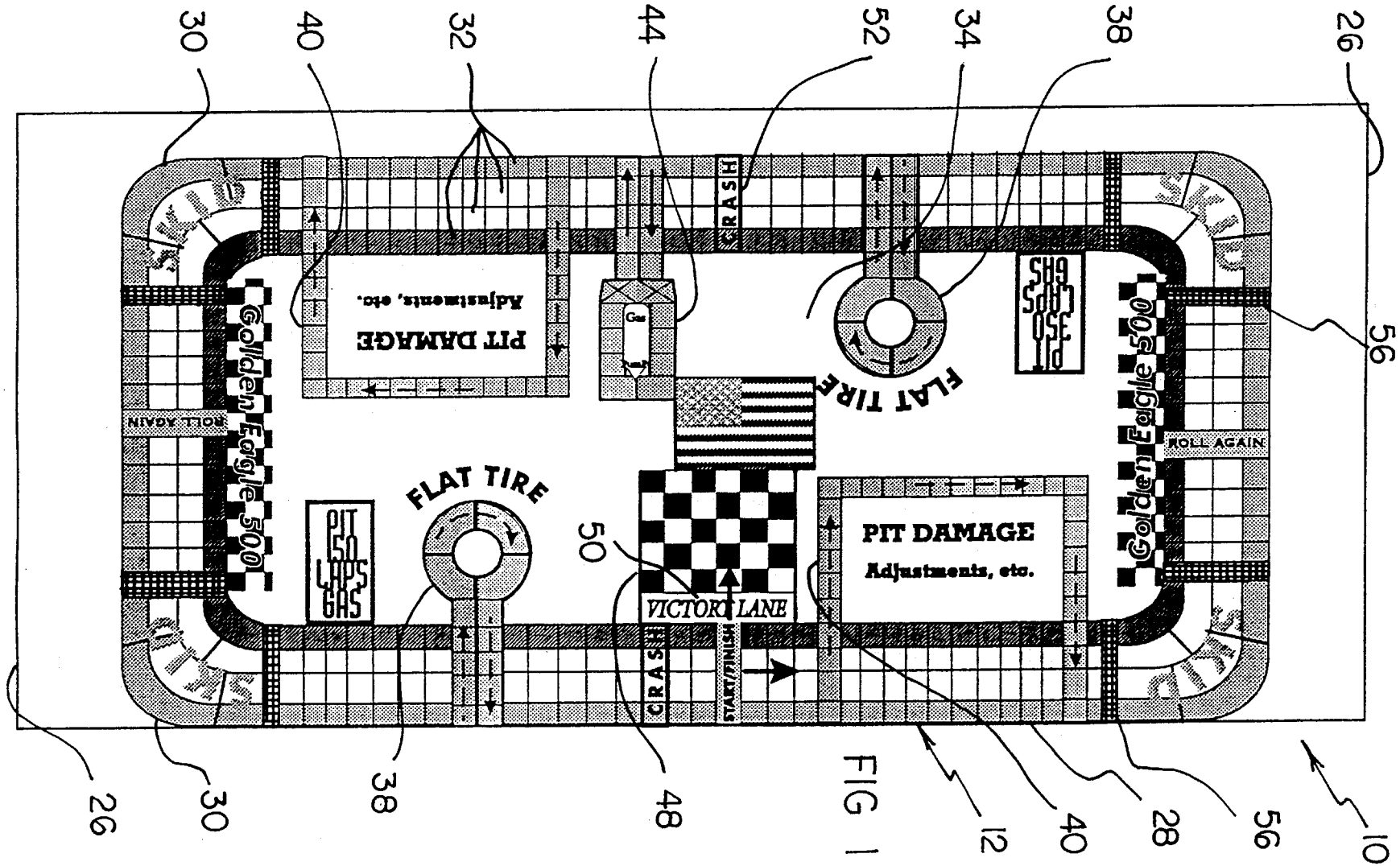
FIG. 1 is a perspective view of the preferred embodiment of the golden eagle 500 board game constructed in accordance with the principles of the present invention.
Figure 2:
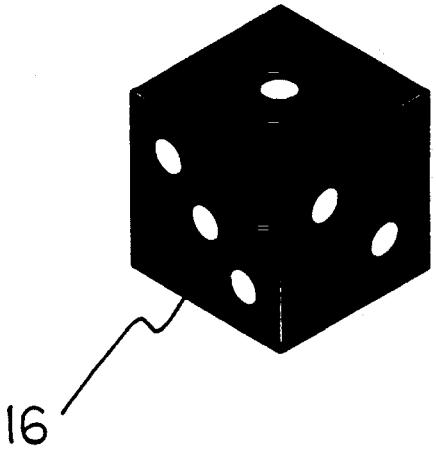
FIG. 2 is a perspective illustration of the black dye with white dots.
Figure 3:
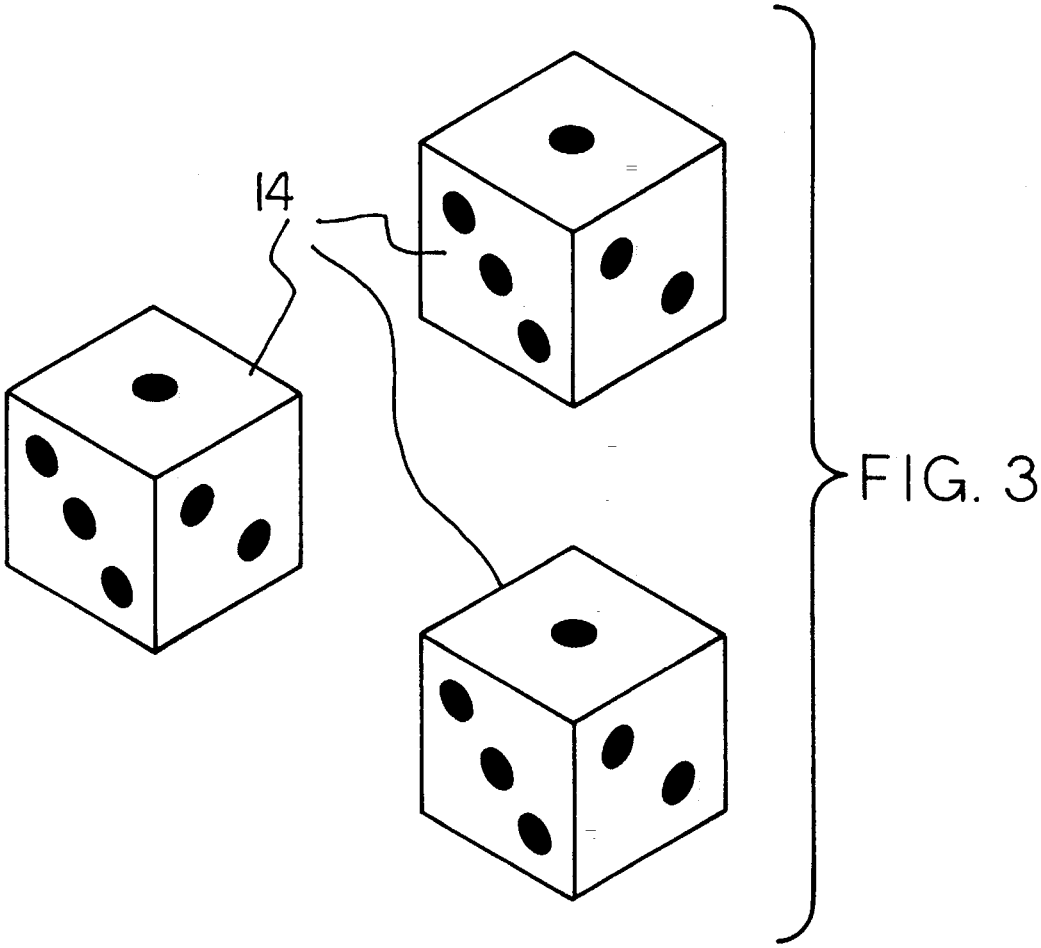
FIG. 3 is a perspective illustration of the three white dice with black spots.

With reference now to the drawings, and in particular to FIG. 1 thereof, the preferred embodiment of the new and improved golden eagle 500 board game embodying the principles and concepts of the present invention and generally designated by the reference numeral 10 will be described.

The present invention, the golden eagle 500 board game 10 is comprised of a plurality of components. Such components in their broadest context include a playing board 12, a four dice 14, 16, a plurality of player tokens 18 and a rule book 20. Such components are individually configured and correlated with respect to each other so as to attain the desired objective.

More specifically, the playing board 12 is fabricated of cardboard and formed in a planar generally rectangular configuration. The board includes one or more centrally positioned fold lines and may be folded down to one half or one quarter size for easy storage. The playing board has an upper surface, a lower surface, parallel long side edges 24 and parallel short side edges 26. In an alternative embodiment of the apparatus a storage box is included to efficiently store the components of the game.

The upper surface of the board includes a generally rectangular shaped race track 28 with rounded edges 30. The track has an outer periphery with four lanes 32 and a center section 34 within the track. In an alternative embodiment of the apparatus the center section includes an American Flag printed within it. Each lane traverses the perimeter of the board and comprises about one hundred individual blocks. During play of the game the user may move his car tokens into any one of the lanes. Since the rules state that a car token can never jump over another car token, players are forced to move their tokens laterally to change lanes. This adds strategy to the game one player can purposefully obstruct another by maneuvering in front of him. This strategy becomes even more important when approaching turns. Note FIG. 1.

The center section 34 of the track has a plurality of structures printed within it. Printed structures 38, 40, and 44 are formed contiguously with the periphery of the track and are comprised of a plurality of red and green printed blocks. The blocks are positioned around the periphery of each structure. The green blocks are entrance blocks and represent one half of the total surrounding the structure. The red blocks are exit blocks and represent one half of the total surrounding the structure. One row of green and red blocks are positioned across all four lanes of the track adjacent to each structure. Red is for out and green is for in. Players landing on a green entrance block are forced to traverse the periphery of the structure.

Two circular shaped printed structures 38 are positioned adjacent to each long side edge. The circular shaped structures include the words FLAT TIRE positioned around them. This structure is designed to simulate the time loss incurred by a driver when a flat tire is encountered. A player landing on a green square adjacent to this structure is required to traverse the blocks of the structure. Two generally rectangular shaped printed structures 40 include the words BIG PIT, Big Damage and are positioned opposite each circular structure. This structure is designed to simulate the time loss incurred by a driver when mechanical failure is encountered. A player landing on a green square adjacent to this structure is required to traverse the blocks of the structure.

A printed structure 44 includes the word Gas printed within it. This structure is designed to simulate the time loss incurred by a driver when refueling is required. The structure is positioned at about the center point of a long side edge of the track. Players are required to traverse the Gas structure during their second and fourth laps. The penalty for not refueling is loss of the offending player's next five turns. Note FIG. 1.

A generally rectangular shaped printed structure 48 includes black and white squares in a checker board configuration. The words VICTORY LANE 50 are positioned between the flags. The words start and finish are positioned adjacent to the VICTORY LANE structure. A set of dark lines across the lanes denote the finish line. This structure simulates the practice of waving the traditional checkered flag.

The word CRASH 52 is positioned at the approximate center point of each long side edge. Player's tokens landing on a crash square are required to move backward the number of blocks indicated by the black die. CRASH and SKID are the same rule.

The corners of the track are rounded and include the word SKID positioned adjacent to it. The blocks of the printed corners are colored white, blue and red. The blue block is positioned closest to the center section of the board. The printed blocks adjacent to the corners are colored solid black to simulate an oil slick 56. Note FIG. 1.

The game includes three six sided white dice 14 with black dots and one six sided black die 16 with white dots. Each die has between one and six dots on each side. A plurality of race car tokens 18 are fabricated in a wide variety of colors, designs, and numbers.

A set of playing rules 20 inform the users how to play the game. The rules are summarized in a rule book. The game is adapted to be played by between one and forty four players. Each player is permitted to control multiple race car tokens. The total amount of tokens permitted in any one game is forty four. The car tokens are positioned adjacent to the start/finish line to begin the game. The first player to reach the finish line after five laps around the track is declared the winner. Upon commencement of their respective turn, each player rolls all four dice and moves the number of blocks indicated by the total of the dice. Player's tokens landing on a crash square are required to move backward the number of blocks indicated by the black die. Players rolling four dice of equal amount are permitted to roll and move again. Note FIGS. 1 and 5.

Players are required to traverse the printed gas structure during their second and fourth laps. The penalty for not refueling is loss of the offending player's next five turns. Players landing on a green block of a structure in the central section of the track are required to traverse the periphery of the structure. Players are prohibited from jumping over other cars as they make their way around the board. Note FIGS. 1, 4 and 5.

In an alternative embodiment of the apparatus an honor roll of famous race car drivers is included with the game. The honor roll includes the names and various career data on the winners of major auto races in the history of auto racing. Players may choose to select their race car tokens based on the winning car numbers and colors of their favorite drivers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved board game comprising, in combination:

a playing board fabricated of cardboard and formed in a planar generally rectangular configuration with an upper surface, a lower surface, parallel long side edges and parallel short side edges, the upper surface of the board including a generally rectangular shaped race track with parallel long regions and parallel short regions with rounded edges therebetween, the track having an outer periphery with four lanes and a center section, each lane traversing the perimeter of the board and comprising one hundred individual printed blocks;

the center section of the track having a plurality of printed structures located therein, each structure being formed contiguously with the periphery of the track, two circular shaped printed structures being positioned adjacent to each long side edge, the circular shaped structures including the words FLAT TIRE positioned therearound, two generally rectangular shaped printed structures including the words PIT DAMAGE and being positioned opposite each circular structure, a printed structure including the word Gas printed therewithin, the Gas structure being positioned at about the center point of a long side edge of the track;

a generally rectangular shaped printed structure including black and white printed squares in a checker board configuration, the words VICTORY LANE being positioned at an end of the structure and offset from the central extent of one long region, the words START/FINISH being positioned adjacent to the words VICTORY LANE and extending across one long region, the word CRASH being positioned at the approximate center point of each long side edge, the corners of the track being rounded and including the word SKID positioned adjacent thereto, the printed blocks of the corners being colored yellow, green and orange, the printed blocks adjacent to the corners being colored all black;

the game including three six sided white dice with black dots, one six sided black die with white dots and a plurality of race car tokens fabricated in a wide variety of colors, designs, and numbers; and a set of playing rules informing the users how to play the game, the game adapted to be played by between one and forty four players, each player being permitted to control multiple race car tokens, the car tokens being positioned adjacent to the start/finish line to begin the game, the first player reaching the finish line after five laps around the track being declared the winner, upon commencement of their turn each player rolling all four dice and moving the number of blocks indicated by the total of the dice, players landing on a crash square being required to move backward the number of blocks indicated by the black die, players rolling four dice of equal amount being permitted to roll and move again, players being required to traverse the printed gas structure during their second and fourth laps or lose their next five turns, the printed gas structure, the printed PIT DAMAGE structure, and the printed FLAT TIRE structure having green and red printed blocks, wherein the red printed blocks are for out and the green printed blocks are for in such that the players landing on a printed green block of a structure in the track are required to traverse the periphery of the associated structure and players are prohibited from jumping over other cars as they make their way around the board.

* * * * *